US006918463B2

(12) United States Patent
Takahashi et al.

(10) Patent No.: US 6,918,463 B2
(45) Date of Patent: Jul. 19, 2005

(54) MUFFLER FOR ENGINE

(75) Inventors: Masanori Takahashi, Toyoake (JP); Kouji Toyoshima, Toyota (JP); Takeshi Inoguchi, Toyota (JP); Shinya Hirota, Susono (JP); Takamitsu Asanuma, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/440,310

(22) Filed: May 19, 2003

(65) Prior Publication Data

US 2004/0026165 A1 Feb. 12, 2004

(30) Foreign Application Priority Data

May 21, 2002 (JP) ..... 2002-146170

(51) Int. Cl.[7] ..... F01N 5/00
(52) U.S. Cl. ..... 181/237; 181/212
(58) Field of Search ..... 181/211, 212, 181/232, 224, 225, 226–237

(56) References Cited

U.S. PATENT DOCUMENTS 4,916,897 A * 4/1990 Hayashi et al. ..... 60/286
6,588,203 B2 7/2003 Hirota et al.
6,755,279 B2 * 6/2004 Kaneko et al. ..... 181/232

FOREIGN PATENT DOCUMENTS

| | | |
|---|---|---|
| EP | 1 245 801 A2 | 10/2002 |
| JP | U-62-021421 | 2/1987 |
| JP | 2-252914 | 10/1990 |
| JP | U-04-040113 | 4/1992 |
| JP | 9-4442 A | 1/1997 |
| JP | 9-88568 A | 3/1997 |

* cited by examiner

*Primary Examiner*—Kimberly Lockett
(74) *Attorney, Agent, or Firm*—Oliff & Berridge PLC

(57) ABSTRACT

A muffler comprises a casing and an exhaust pipe penetrating the casing. An exhaust gas chamber 4 is defined between the outer wall surface of the exhaust pipe and the inner wall surface of the casing. In the exhaust pipe positioned in the casing, an enlarged chamber for accommodating a particulate filter is formed. A downstream side portion of the exhaust pipe and the exhaust gas chamber are communicated with each other by a branch pipe. A communicating port is formed on the wall of an upstream side portion of the exhaust pipe positioned in the exhaust gas chamber. Until the pressure difference between the upstream and downstream of the communication control valve reaches a threshold value, the communication control valve is kept closed to close the communicating port and, thus, the exhaust gas flows through the particulate filter. When the pressure difference has reached the threshold value, the communication control valve is opened by the pressure in the upstream side portion to open the communicating port and, thus, a part of the exhaust gas bypasses the particulate filter.

9 Claims, 4 Drawing Sheets

MUFFLER FOR ENGINE

BACKGROUND OF THE INVENTION

1. Field of the Invention

The present invention relates to a muffler for an engine.

2. Related Art

A muffler for an engine having: a casing; an exhaust pipe penetrating and extending through the casing; an enlarged chamber having a volume and formed in the exhaust pipe positioned in the casing, the enlarged chamber accommodating therein a catalyst; an upstream side communicating passage communicating an exhaust gas chamber, which is defined between an outer wall surface of the exhaust pipe and an inner wall surface of the casing, and the exhaust pipe upstream of the enlarged chamber with each other; a downstream side communicating passage communicating the exhaust gas chamber and the exhaust pipe downstream of the enlarged chamber with each other, wherein the upstream side communicating passage is closed when the temperature of the exhaust gas is low, and is opened when the temperature of the exhaust gas becomes high, whereby when the temperature of the exhaust gas is low, the exhaust gas flows through the catalyst, and when the temperature of the exhaust gas becomes high, a part of the exhaust gas flows out from the exhaust pipe, via the upstream side communicating passage, into the exhaust gas chamber, and then bypasses the enlarged chamber and returns into the exhaust pipe via the downstream side communicating passage (Refer to Japanese Unexamined Patent Publication No. 9-88568) is known. In other words, in the muffler, in order to prevent the catalyst from being overheated, a part of the exhaust gas is forced to bypass the catalyst when temperature of the exhaust gas is high.

In the muffler above mentioned, when the upstream side communicating passage is opened, a pressure loss of the muffler is decreased. Therefore, a back pressure of the engine can be lowered at this time.

However, in the muffler, the upstream side communicating passage is kept closed as long as the exhaust gas temperature is low. As a result, a problem may occur in which the back pressure of the engine increases when, for example, the engine temperature is low.

SUMMARY OF THE INVENTION

An object of the present invention is to provide a muffler for an engine, capable of maintaining the back pressure on the engine low.

According to the present invention, there is provided a muffler for an engine having an exhaust passage, the muffler comprising: a casing; an exhaust pipe penetrating and extending through the casing, the exhaust pipe adapted to be connected with the exhaust passage of the engine; an enlarged chamber having a volume and formed in the exhaust pipe positioned in the casing, the enlarged chamber being adapted to accommodate therein a particulate filter for collecting particulates contained in exhaust gas flowing into the enlarged chamber or a catalyst; an upstream side communicating passage communicating an exhaust gas chamber, which is defined between an outer wall surface of the exhaust pipe and an inner wall surface of the casing, and the exhaust pipe upstream of the enlarged chamber with each other; a downstream side communicating passage communicating the exhaust gas chamber and the exhaust pipe downstream of the enlarged chamber with each other; and a communication control means for closing the upstream side communicating passage until the pressure in the exhaust pipe upstream of the enlarged chamber reaches a predetermined threshold value and for opening the upstream side communicating passage when the above-mentioned pressure reaches the threshold value wherein, when the upstream side communicating passage is closed, the exhaust gas flows through the enlarged chamber, and when the upstream side communicating passage is opened, a part of the exhaust gas flows out from the exhaust pipe, via the upstream side communicating passage, into the exhaust gas chamber, and then bypasses the enlarged chamber and returns into the exhaust pipe via the downstream side communicating passage.

Note that, in this specification, a ratio of an amount of air to amounts of hydrocarbon HC and carbon monoxide CO, supplied into an exhaust passage, a combustion chamber and an intake passage of the engine, upstream of a certain position in the exhaust passage, are referred to as an air-fuel ratio of the exhaust gas at the above-mentioned position.

The present invention may be more fully understood from the description of the preferred embodiments of the invention, as set forth below, together with the accompanying drawings.

DESCRIPTION OF THE PREFERRED EMBODIMENTS

Figure 1A:
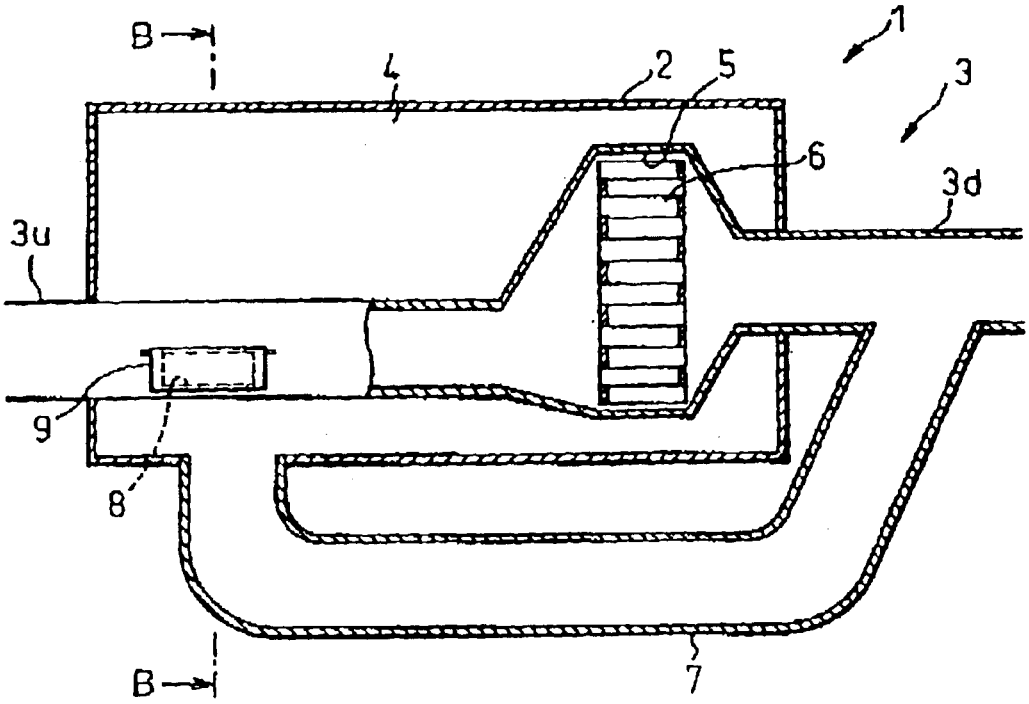
FIG. 1A is a lateral sectional view of a muffler of an embodiment according to the present invention.
Figure 1B:
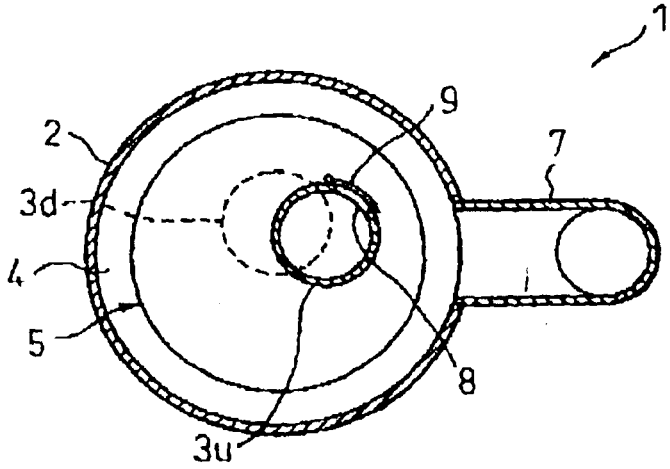
FIG. 1B is a longitudinal sectional view of a muffler, taken along the line B—B shown in FIG. 1A.

FIGS. 1A and 1B show a structure of a muffler 1 of an embodiment according to the present invention. FIG. 1A is a lateral sectional view of the muffler 1, and FIG. 1B is a longitudinal sectional view of the muffler 1 taken along the line B—B shown in FIG. 1A.

Referring to FIGS. 1A and 1B, the muffler 1 comprises a casing 2 having, for example, a cylindrical shape, and an exhaust pipe 3 adapted to be connected with an exhaust pipe of an internal combustion engine. The exhaust pipe 3 penetrates and extends through the casing 2, and thus an annular exhaust gas chamber 4, having a relatively large volume, is defined between the outer wall surface of the exhaust pipe 3 and the inner wall surface of the casing 2.

An enlarged chamber 5 having a relatively large volume is formed in the exhaust pipe 3 positioned in the casing 2. In the enlarged chamber 5, a particulate filter 6 for collecting particulates contained in the exhaust gas flowing into the enlarged chamber 5 is accommodated. The particulate filter 6 carries thereon a catalyst. Any type of catalyst may be carried on the particulate filter 6, and, for example, an oxidizing catalyst or a $NO_x$ catalyst may be carried on the particulate filter 6. The $NO_x$ catalyst stores therein $NO_x$ contained in the inflowing exhaust gas when the air-fuel ratio of the inflowing exhaust gas is lean, and reducing $NO_x$ stored therein to reduce an amount of $NO_x$ stored therein when a reducing agent is contained in the inflowing exhaust gas and the air-fuel ratio of the inflowing exhaust gas is lowered. In this connection, only the particulate filter 6 or the catalyst may be accommodated in the enlarged chamber 5.

In a case where the enlarged chamber 5 is arranged in the casing 2 as described above, the particulate filter 6 is surrounded by a layer of gas in the exhaust gas chamber 4. Accordingly, it is possible to prevent the temperature of the particulate filter 6 being decreased.

Here, a portion of the exhaust pipe 3 upstream of the enlarged chamber 5 is referred to as an upstream side portion 3*u*, and a portion of the exhaust pipe 3 downstream of the enlarged chamber 5 is referred to as a downstream side portion 3*d*. A branch pipe 7 branches off from the downstream side portion 3*d* outside the casing 2. The branch pipe 7 extends outside the casing 2 and opens onto the peripheral wall of the casing 2, and communicates the downstream side portion 3*d* and the exhaust gas chamber 4 with each other. In this way, in the embodiment shown in FIGS. 1A and 1B, the entire of the branch pipe 7 is located outside the casing 2.

On the other hand, a communicating port 8 is formed on the wall of the upstream side portion 3*u*, and the upstream side portion 3*u* is provided with a communication control valve 9 for opening or closing the communicating port 8. A valve body of the communication control valve 9 extends along the outer circumferential surface of the upstream side portion 3*u* while covering the communicating port 8, and is pivotably supported at its one side.

In the embodiment of the present invention, the communication control valve 9 comprises a valve of a pressure driven type, which is opened by the pressure, especially by the static pressure, in the upstream side portion 3*u*. In other words, the communication control valve 9 is biased toward a closing position in which it closes the communication port 8 by a spring or the like. Until the pressure in the upstream side portion 3*u* or, more precisely, a pressure difference between the upstream side portion 3*u* and the exhaust gas chamber 4, or between the upstream and the downstream of the communication control valve 9, reaches a predetermined threshold value, the communication control valve 9 is closed to close the communicating port 8. When the above-mentioned pressure difference reaches the threshold value, the communication control valve 9 is opened to open the communicating port 8.

Figure 2:
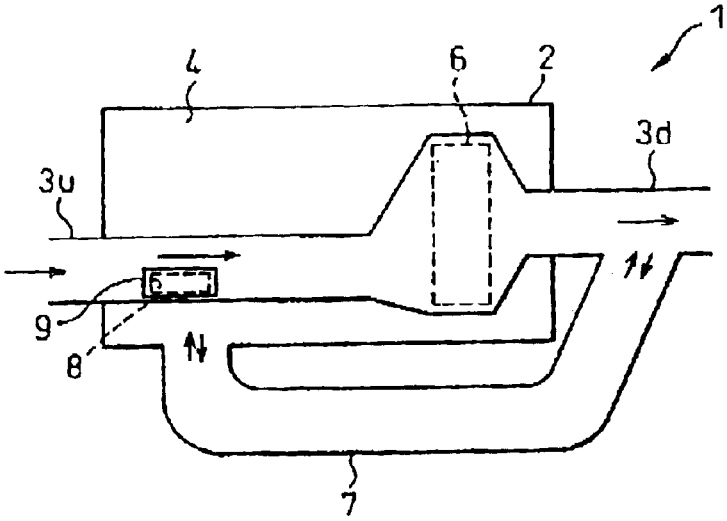
FIG. 2 is a view showing a flow of exhaust gas.

When the pressure in the upstream side portion 3*u* is low and thus the pressure difference between the upstream and the downstream of the communication control valve 9 is relatively small, as in low-speed engine operation, the communication control valve 9 is kept closed. As a result, as shown in FIG. 2, all of the exhaust gas flowing into the upstream side portion 3*u* passes through the particulate filter 6, and then flows through the downstream side portion 3*d*. In this case, the exhaust gas chamber 4 is separated from the upstream side portion 3*u*, and acts as a resonance chamber. As a result, an intensity of noise is suppressed by the resonance effect of the exhaust gas chamber 4.

In general, a frequency of noise suppressed by the resonance effect of the exhaust gas chamber 4 is determined by dimensions of the branch pipe 7 acting as a resonance pipe, that is, the length along the central axis and the diameter of the branch pipe 7. Therefore, in the embodiment according to the present invention, the dimensions of the branch pipe 7 is set to make the frequency of noise suppressed by the resonance effect of the exhaust gas chamber 4 coincide with a predetermined target frequency.

Figure 3A:
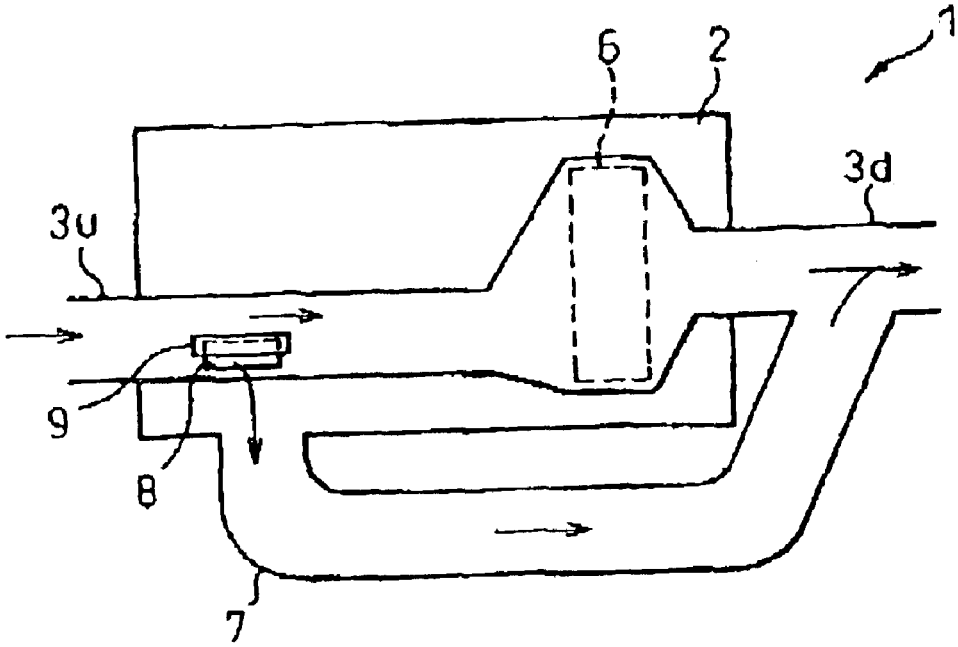
FIGS. 3A and 3B are a view showing a flow of exhaust gas.
Figure 3B:
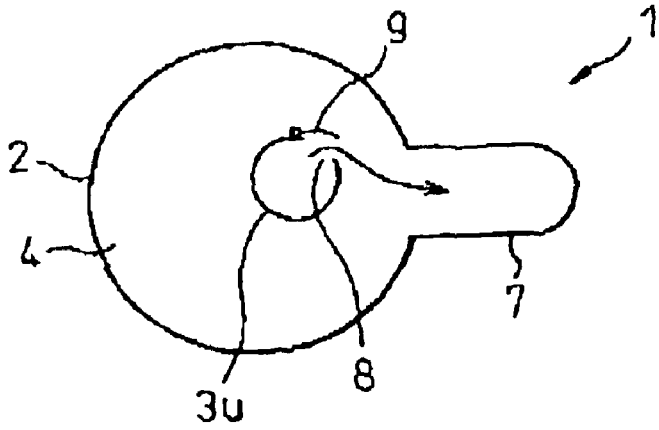

On the other hand, when the pressure in the upstream side portion 3*u* becomes high as in the engine high speed operation, and thus the pressure difference between the upstream and the downstream of the communication control valve 9 reaches the threshold value, the communication control valve 9 is opened to open the communicating port 8, and thus the upstream side portion 3*u* and the exhaust gas chamber 4 are communicated with each other by the communicating port 8. As a result, as shown in FIGS. 3A and 3B, a part of the exhaust gas flowing into the upstream side portion 3*u* flows out into the exhaust gas chamber 4 via the communicating port 8, and then flows into the downstream side portion 3*d* via the branch pipe 7. This results in the part of the exhaust gas bypassing the particulate filter 6, and decreases the back pressure of the engine.

At this time, as shown in FIG. 3B, the exhaust gas is guided by the valve body of the communication control valve 9 toward the opening of the branch pipe 7 of the exhaust gas chamber 4 side. As a result, the back pressure of the engine is further decreased.

As described above, the volume of the exhaust gas chamber 4 is relatively large, and thus the exhaust gas chamber 4 acts as an expansion chamber when the communication control valve 9 is opened. As a result, the intensity of a noise is suppressed by the expansion effect of the exhaust gas chamber 4.

In the embodiment shown in FIGS. 1A and 1B, the entire branch pipe 7 is located outside the casing 2. This means that the volume of the exhaust gas chamber 4 can be enlarged while the volume of the casing 2 is being kept small. On the other hand, in general, the resonance effect becomes larger as the volume of the resonance chamber becomes larger, and the expansion effect becomes higher, as the volume of the expansion chamber becomes larger. In this way, in either case, it is possible to greatly suppress an intensity of a noise. Accordingly, in the embodiment shown in FIGS. 1A and 1B, it is possible to greatly suppress an intensity of a noise both when the exhaust gas chamber 4 acts as a resonance chamber and when the exhaust gas chamber 4 acts as an expansion chamber.

In this connection, in the embodiment of the present invention, the exhaust gas chamber 4 acts as a resonance chamber when the communication control valve 9 is closed, and acts as an expansion chamber when the communication control valve 9 is opened. Accordingly, it is possible to consider the communication control valve 9 as a changeover valve for changing an operation of the exhaust gas chamber 4 between a resonance chamber and an expansion chamber.

Figure 4:
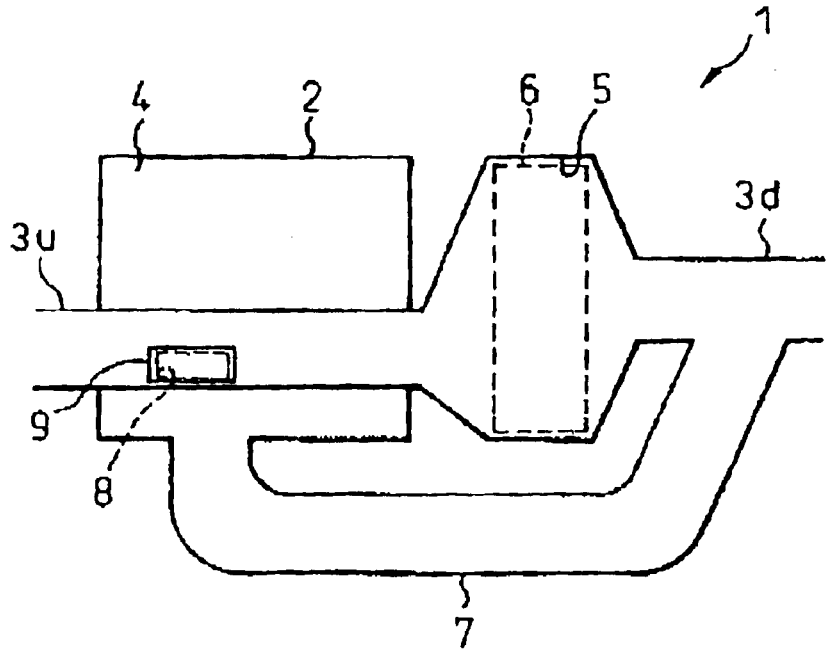
FIG. 4 is a view showing a muffler structure of another embodiment according to the present invention.

In the embodiment shown in FIGS. 1A and 1B, the enlarged chamber 5 is arranged in the casing 2. Alternatively, as shown in FIG. 4, the enlarged chamber 5 may be arranged downstream the casing 5, that is, outside the casing 2.

Figure 5:
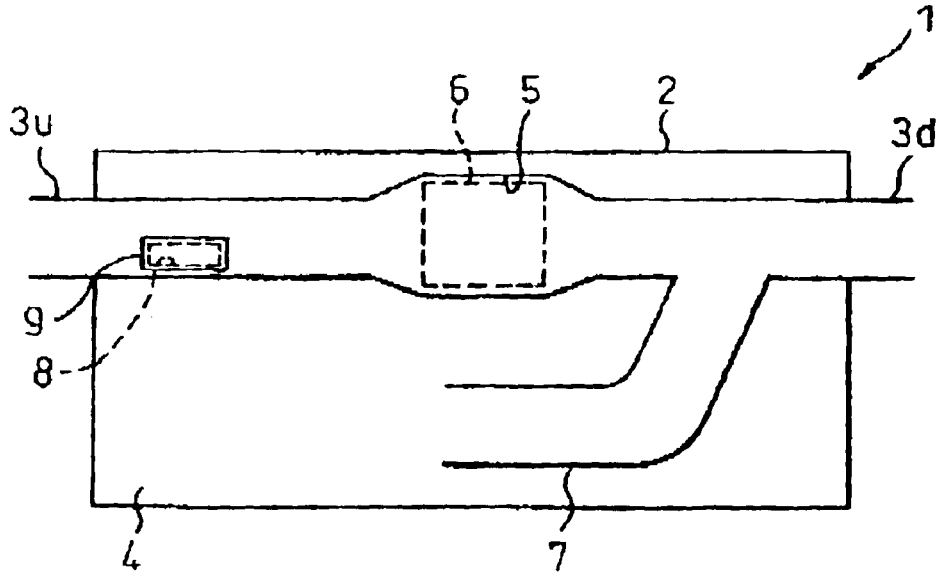
FIG. 5 is a view showing a muffler structure of another embodiment according to the present invention.

In the embodiment shown in FIGS. 1A and 1B, the entire branch pipe 7 is arranged outside the casing 2. Alternatively, as shown in FIG. 5, the entire of the branch pipe 7 may be arranged in the casing 2. In this case, the branch pipe 7 branches off from the downstream side portion 3*d* located in the casing 2. Further alternatively, only a part of the branch pipe 7 may be arranged in the casing 2. Which structure is selected from the embodiments shown in FIGS. 1A and 1B, 4, and 5, depends on, for example, a frequency of the sound, the intensity of which is to be reduced.

According to the present invention, it is possible to provide a muffler for an engine, capable of maintaining the back pressure of the engine low.

While the invention has been described by reference to specific embodiments chosen for purposes of illustration, it should be apparent that numerous modifications could be made thereto by those skilled in the art without departing from the basic concept and scope of the invention.

What is claimed is:

1. A muffler for an engine having an exhaust passage, the muffler comprising:

a casing;

an exhaust pipe penetrating and extending through the casing, the exhaust pipe adapted to be connected with the exhaust passage of the engine;

an enlarged chamber having a volume and formed in the exhaust pipe positioned in the casing, the enlarged chamber being adapted to accommodate therein a particulate filter for collecting particulates contained in exhaust gas flowing into the enlarged chamber or a catalyst;

an upstream side communicating passage communicating an exhaust gas chamber, which is defined between an outer wall surface of the exhaust pipe and an inner wall surface of the casing, and the exhaust pipe upstream of the enlarged chamber with each other;

a downstream side communicating passage communicating the exhaust gas chamber and the exhaust pipe downstream of the enlarged chamber with each other; and a communication control means for closing the upstream side communicating passage until the pressure in the exhaust pipe upstream of the enlarged chamber reaches a predetermined threshold value and for opening the upstream side communicating passage when the above-mentioned pressure reaches the threshold value, wherein when the upstream side communicating passage is closed, the exhaust gas flows through the enlarged chamber, and when the upstream side communicating passage is opened, a part of the exhaust gas flows out from the exhaust pipe, via the upstream side communicating passage, into the exhaust gas chamber, and then bypasses the enlarged chamber and returns into the exhaust pipe via the downstream side communicating passage.

2. A muffler for an engine according to claim 1, wherein the communication control means comprises a communication control valve, which is kept closed until the pressure in the exhaust pipe upstream of the enlarged chamber reaches the threshold value, to close the upstream side communicating passage, and which is opened when pressure in the exhaust pipe upstream of the enlarged chamber reaches the threshold value to open the upstream side communicating passage.

3. A muffler for an engine according to claim 2, wherein the communication control valve comprises a valve, of a pressure driven type, which is opened by the pressure in the exhaust pipe upstream of the enlarged chamber.

4. A muffler for an engine according to claim 1, wherein the upstream side communicating passage is defined by a communicating port formed on the wall of the exhaust pipe positioned in the exhaust gas chamber and upstream of the enlarged chamber.

5. A muffler for an engine according to claim 1, wherein the downstream side communicating passage is defined by a branch pipe which branches off and extends from the exhaust pipe downstream of the enlarged chamber and opens into the exhaust gas chamber.

6. A muffler for an engine according to claim 5, wherein the branch pipe branches off and extends from the exhaust pipe outside the exhaust gas chamber and downstream of the enlarged chamber and opens onto an external wall surface of the casing.

7. A muffler for an engine according to claim 5, wherein the exhaust gas chamber acts as a resonance chamber when the upstream side communicating passage is closed, and wherein dimensions of the branch pipe are set to make the frequency of noise suppressed by the resonance effect of the exhaust gas chamber coincide with a predetermined target frequency.

8. A muffler for an engine according to claim 5, wherein the upstream side communicating passage is defined by a communicating port formed on the wall of the exhaust pipe positioned in the exhaust gas chamber and upstream of the enlarged chamber, wherein the communication control means comprises a communication control valve, which is kept closed until the pressure in the exhaust pipe upstream of the enlarged chamber reaches the threshold value, to close the communicating port, and which is opened when pressure in the exhaust pipe upstream of the enlarged chamber reaches the threshold value to open the communicating port, and wherein when the communication control valve is opened, a flow of the exhaust gas is guided, by a valve body of the communication control valve, toward an opening of the branch pipe positioned the exhaust gas chamber side.

9. A muffler for an engine according to claim 1, wherein the particulate filter is accommodated in the enlarged chamber, the particulate filter carrying thereon a $NO_x$ catalyst, the $NO_x$ catalyst storing therein $NO_x$ contained in the inflowing exhaust gas when the air-fuel ratio of the inflowing exhaust gas is lean, and reducing $NO_x$ stored therein to reduce an amount of $NO_x$ stored therein when a reducing agent is contained in the inflowing exhaust gas and the air-fuel ratio of the inflowing exhaust gas is lowered.

* * * * *